US005209335A

United States Patent [19]

Shuren et al.

[11] Patent Number: 5,209,335

[45] Date of Patent: May 11, 1993

[54] SECURITY ARRANGEMENT FOR USE WITH A LOCKABLE, REMOVABLE CASSETTE

[75] Inventors: Thomas Shuren; John Zouzoulas, both of West Chester, Pa.

[73] Assignee: Mars Incorporated, McLean, Va.

[21] Appl. No.: 792,147

[22] Filed: Nov. 8, 1991

[51] Int. Cl.[5] ..... G07F 7/04

[52] U.S. Cl. ..... 194/200; 194/206

[58] Field of Search ..... 794/200, 206, 207

[56] References Cited

U.S. PATENT DOCUMENTS

| | | | |
|---|---|---|---|
| 4,136,262 | 1/1979 | Clark, Jr. . | |
| 4,380,316 | 4/1983 | Glinka et al. | 232/16 |
| 4,471,905 | 9/1984 | Sloma et al. | 232/12 |
| 4,678,072 | 7/1987 | Kobayashi et al. | 194/206 |
| 4,949,901 | 8/1990 | Harris | 232/15 |
| 4,976,346 | 12/1990 | Juds et al. | 194/200 |
| 4,977,583 | 12/1990 | Gorgone | 377/8 |
| 4,997,128 | 3/1991 | Suris | 232/16 |
| 5,076,413 | 12/1991 | Davila et al. | 194/206 |

FOREIGN PATENT DOCUMENTS

| | | | |
|---|---|---|---|
| 86/05301 | 9/1986 | World Int. Prop. O. | 194/206 |

*Primary Examiner*—F. J. Bartuska

*Attorney, Agent, or Firm*—Davis, Hoxie, Faithfull & Hapgood

[57] ABSTRACT

A method and apparatus to prevent fraud in a bill acceptor system utilizing a lockable, removable cassette is disclosed. A security arrangement including a security sensor and a microprocessor monitors the attachment of the cassette for proper installation, and monitors the bill pusher cycle when an accepted bill is loaded into the cassette. If the cassette is not properly installed or if a bill pusher cycle fails to complete, indicating a possible fraud attempt, then the bill validator is disabled.

17 Claims, 7 Drawing Sheets

SECURITY ARRANGEMENT FOR USE WITH A LOCKABLE, REMOVABLE CASSETTE

FIELD OF THE INVENTION

The present invention relates generally to a security arrangement for use with a removable cassette. More particularly, the present invention relates to a security sensor and method for use with a lockable, removable cassette which securely stores bills received from a bill acceptor.

BACKGROUND OF THE INVENTION

It is well known that temptations arise when service personnel handle cash collected by a currency validator. It is also known that vandals target currency validators. Thus, it is expected that tampering may occur regarding the cash box connected to such devices.

When a cash box which contains cash that is less than that amount for which services or change were rendered is delivered to a central office, it is uncertain whether or not the validator malfunctioned, or if the serviceman is dishonest. Therefore, it is desirable to provide a security sensor to monitor the installation and use of a removable, lockable cash box.

Lockable, removable cash boxes for use with currency validators providing various degrees of security have been developed. See, for example, U.S. Pat. Nos. 4,997,128 and 4,949,901. In these patents, a cash box connected to a currency validator receives accepted bills and locks prior to its removal from the validator. Service personnel remove the cash box at predetermined intervals or when it is full, and replace it with another empty one.

Other prior art patents disclose electronic counters and other circuitry to attempt to deal with the potential theft and fraud problems. See, for example, U.S. Pat. Nos. 4,977,583 and 4,976,346.

SUMMARY OF THE INVENTION

The apparatus of the present invention provides a security sensor and method for using this sensor in conjunction with a bill acceptor system. A typical bill acceptor system comprises a bill validator, a bill pusher and a removable cash box. The security sensor provides improved security for the owner of the bill acceptor system by preventing fraudulent practices which will be explained below.

A lockable, removable cassette apparatus is desirable when improved security is necessary, such as when somewhat higher priced products or services are to be vended. For example, a lockable, removable cassette may be used to store high denomination bills accepted by a bill validator, such as 5-dollar, 10-dollar and 20-dollar bills, resulting in a large amount of money being stored in the lockable, removable cassette.

A lockable, removable cassette of a type for use with the security sensor of the present invention is rectangular in shape, and has a casing composed of metal or another durable material. A knob or lever located on the outside front wall of the cassette is turned by service personnel to mount and dismount the cassette to a bill acceptor unit. As the lever is turned to remove the cassette, a pusher plate retracts to cover a bill opening and locks in position to prevent access to the stored bills. The locked cassette is transported back to a central office where a separate key is used to open a separate, hinged door to access the stored bills. To reconnect an empty cassette to a bill acceptor unit, the serviceman turns the lever again as he attaches the cassette, which returns the pusher plate to its open position.

The present invention indicates when the cassette is properly connected to the bill acceptor apparatus. One embodiment of the security sensor comprises a switch pin for sensing the position of the pusher plate of the removable cassette, and a microswitch for sending a signal to a processing and control circuit when the cassette is properly installed. If this signal is not sent, then the bill validator will not function.

When the pusher plate is in its open position it contacts the switch pin to close the microswitch of th security sensor. When a bill is accepted, the bill pusher pushes the pusher plate and the bill into a bill compartment of the cassette, and the pusher plate moves away from the switch pin which in turn opens the microswitch. The pusher plate then returns to its open position and contacts the switch pin which closes the microswitch. This sequence of opening and closing the microswitch is monitored by the processing and control circuit. In addition, an existing motor home sensor associated with the bill pusher is also monitored. The processing and control circuit compares the signals generated by the security sensor and the motor home sensor during a bill pusher cycle to make sure that they occurred in synchronism. If they did not occur in proper synchronism then the bill acceptor is disabled.

When an empty cassette is attached to a bill pusher by a serviceman, a stacking cycle is initiated and monitored. If asynchronous operation of the security sensor is detected, the bill validator goes out of service. This prevents attempts to trick the bill acceptor into stacking bills outside the cassette by manually triggering the security sensor. In addition, the present invention monitors the bill pusher cycle during normal operation to detect possible jam conditions.

Thus, a security sensor for use with a lockable, removable cassette in accordance with the present invention prevents fraud. These and other advantages will be apparent from the following detailed description. It will also be apparent that an embodiment of the invention need not achieve all of the advantages outlined herein to come within the scope of the present invention as defined by the claims.

Throughout this specification and claims, where reference is made to a "bill" or "bills", the reference is intended to include all types of paper currency and the like.

DETAILED DESCRIPTION

Figure 1:
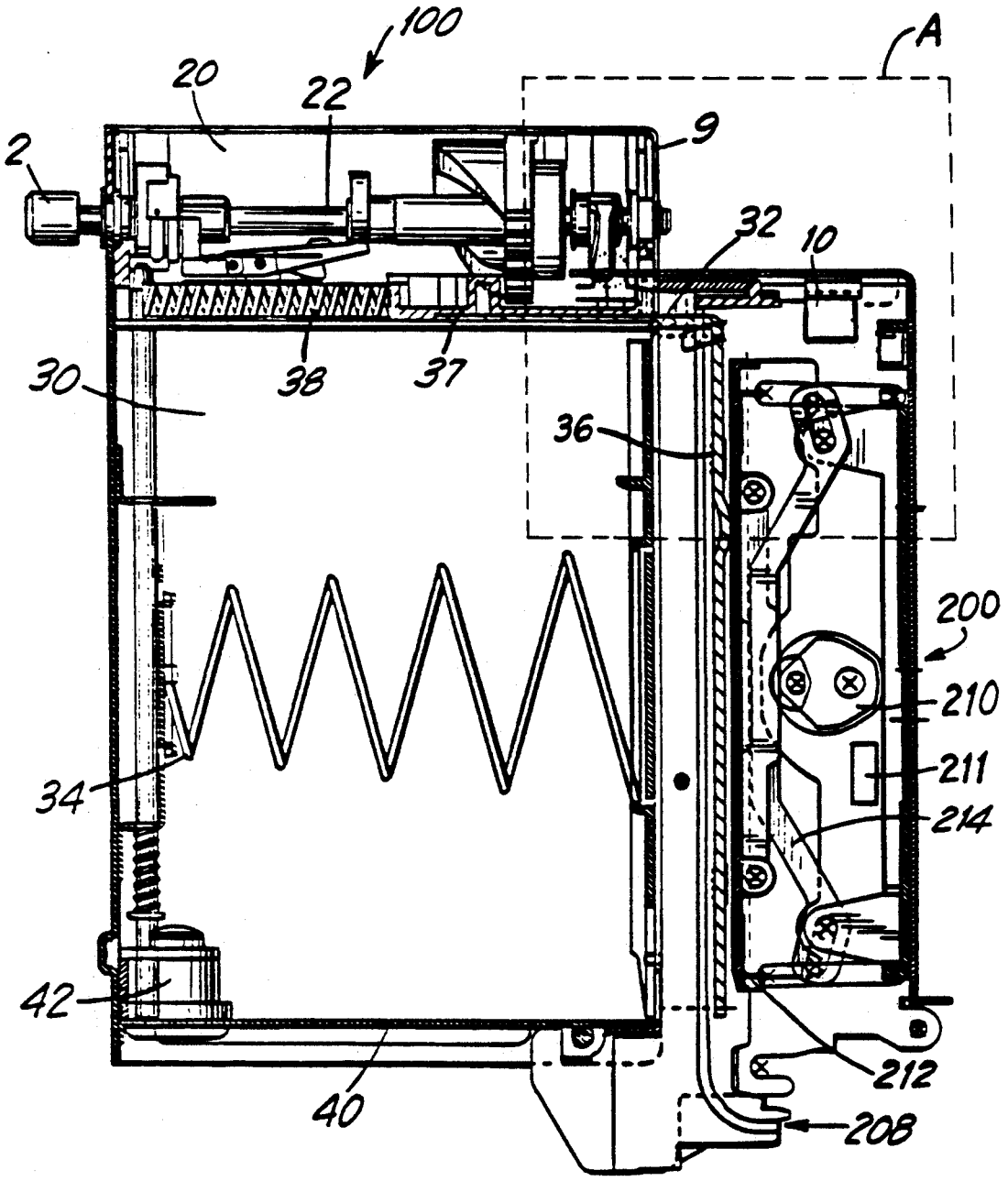
FIG. 1 is a cutaway side view of a lockable, removable cassette shown connected to a bill pusher, illustrating the position of one embodiment of the security sensor.

FIG. 1 is a detailed cutaway side view of an empty lockable, removable cassette 100 and a bill pusher 200, both of a type that may be suitably used with the present invention. A security sensor 10 is shown attached to the bill pusher 200. Sensor 10 is actuated by a pusher plate 36 of the cassette 100, as will be described below.

A bill acceptor system typically comprises a bill validator, a bill pusher and a bill storage box. Referring to FIG. 1, accepted bills are transported along a bill path 208 by a bill validator (not shown), and an actuator plate 212 of the bill pusher 200 then contacts a pusher plate 36 to push the bill into a bill compartment 30 where it is stored. The cassette 100, bill pusher 200 and the validator are typically enclosed within a locked cabinet so that only the face of the validator is accessible to the public.

Further details of one example of a suitable bill pusher for use with the present invention, when modified as taught herein, are described in U.S. Pat. No. 4,765,607, assigned to the assignee of the present application. Similarly, further details of one example of a suitable lockable, removable cassette, when modified as taught herein, for use with the present invention are described in U.S. application No. 07/704,787, assigned to the assignee of the present invention. The disclosures of both the above identified patent and application are incorporated by reference herein.

Figure 2:
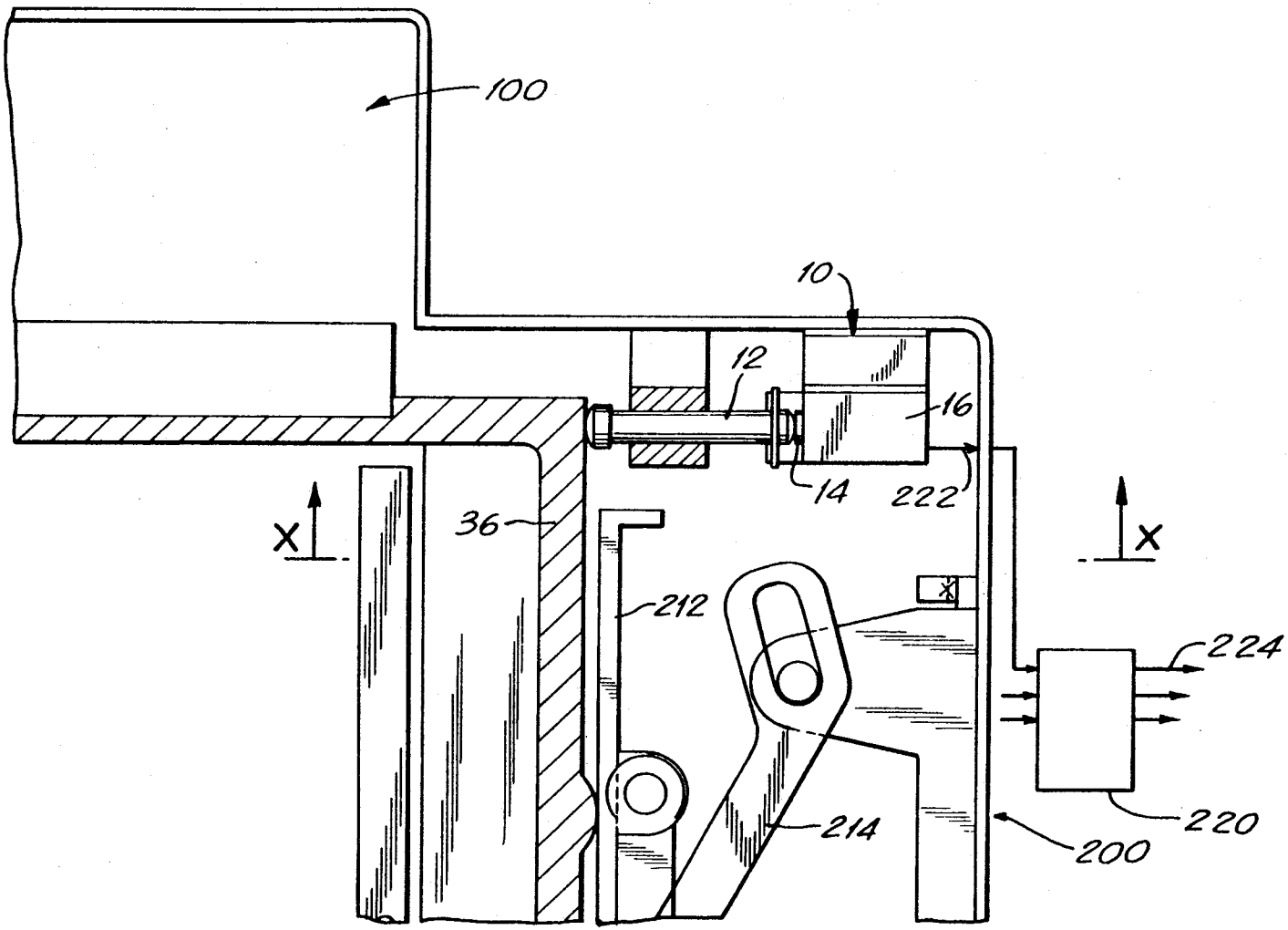
FIG. 2 is an enlarged, simplified illustration of block "A" of FIG. 1 depicting an embodiment of the security sensor.

FIG. 2 is an enlarged, simplified illustration of block "A" of FIG. 1 depicting one embodiment of a security sensor 10 according to the present invention. The security sensor 10 comprises a switch pin 12, an actuator element 14 and a microswitch 16. The switch pin 12 of sensor 10 may move back and forth in a horizontal plane and contacts the actuator element 14 on one end, and may contact the pusher plate 36 on the other end, as shown. It is noted that other sensor switch arrangements may be readily used. The security sensor 10 has an output 222 to transmit signals indicative of the microswitch 16 closing or opening to a microprocessor 220. An output 224 of the microprocessor 220 is used to enable or disable bill acceptor operation, as will be described below.

In order to fully understand the utility of the present invention it is useful to briefly discuss the procedures followed when utilizing a lockable, removable cassette. A serviceman typically removes a cassette at predetermined intervals or when the cassette is full of bills. Referring to FIG. 1, a lever 2 is turned to a first predetermined position to unlock the cassette from the bill pusher. The cassette is then removed and transported back to a central office. A separate key is used by an authorized person to unlock a lock 42 to permit a hinged door 40 to be opened, to remove stored bills. After the bills are removed, the cassette 100 is given back to the serviceman for connection to another bill acceptor. When reconnecting the cassette, the serviceman turns the lever 2 to a second predetermined position to attach and lock the cassette to the bill pusher.

Referring to FIG. 1, the cassette 100 is comprised of two compartments: a shaft compartment 20 and a bill storage compartment 30. The shaft compartment 20 houses a mechanism which locks the cassette 100 to the bill pusher 200, and which secures the bill storage compartment 30 upon removal of the cassette by locking the pusher plate 36 in place to cover the bill opening. A locking shaft 22 rotates when the lever 2 is turned, and various cams mounted on the locking shaft 22 also turn. Details concerning how these cams work when the cassette 100 is attached to, and removed from, a bill pusher are discussed in U.S. application Ser. No. 07/704,787. Thus, servicemen merely turn the lever 2 to remove full cassettes and to attach empty cassettes, and are unaware of the inner workings of the cassette.

Figure 4:
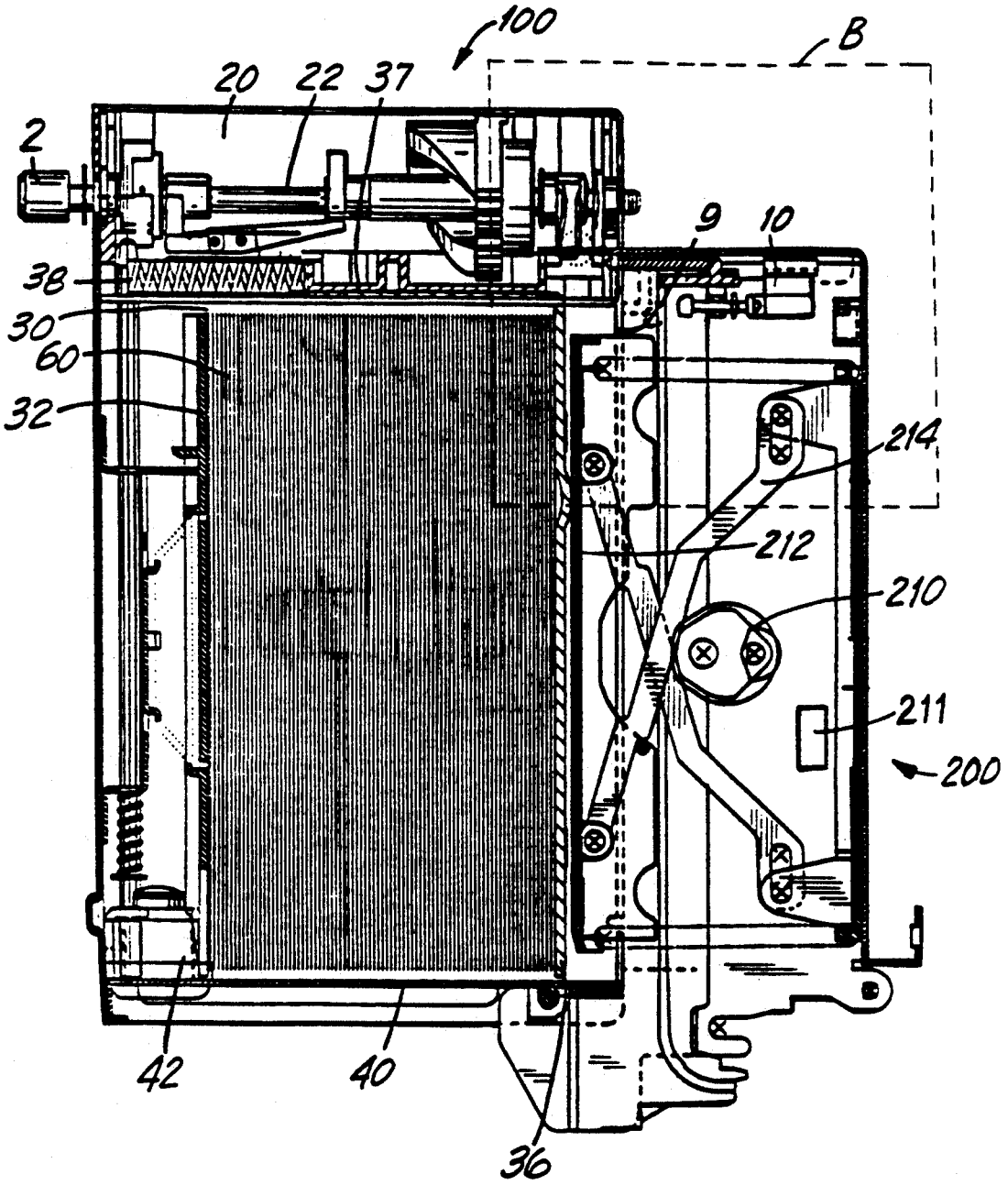
FIG. 4 is a cutaway side view of the cassette of FIG. 1 illustrating how bills are loaded and stored in the cassette.

During operation of the bill acceptor system, an accepted bill is transported along a bill path 208 behind the pusher plate 36. When the bill reaches the top of bill path 208 the bill pusher 200 pushes the bill towards the bill compartment 30. A motor (not shown) is energized to move the camming arrangement 210 to extend a scissors arrangement 214 to drive actuator plate 212 into the pusher plate 36. The pusher plate 36 then pushes the bill through an opening (not shown) in the rear wall 9 of the cassette and into the bill compartment 30 to contact a pressure plate 32. FIG. 4 depicts the actuator plate 212 and the pusher plate 36 extended past the rear wall 9 and into the bill compartment 30.

The pusher plate 36 is rigidly connected to a sliding pad 37 which rides on tracks (not shown) in the shaft compartment 20. Two springs 38 act to bias the sliding pad 37 towards the rear wall 9 of the cassette. After a bill has been loaded into the bill compartment 30, the actuator plate 212 is retracted, and the pusher plate 36 in response to the bias supplied by the springs 38 returns to its open position, shown in FIG. 1.

Figure 3:
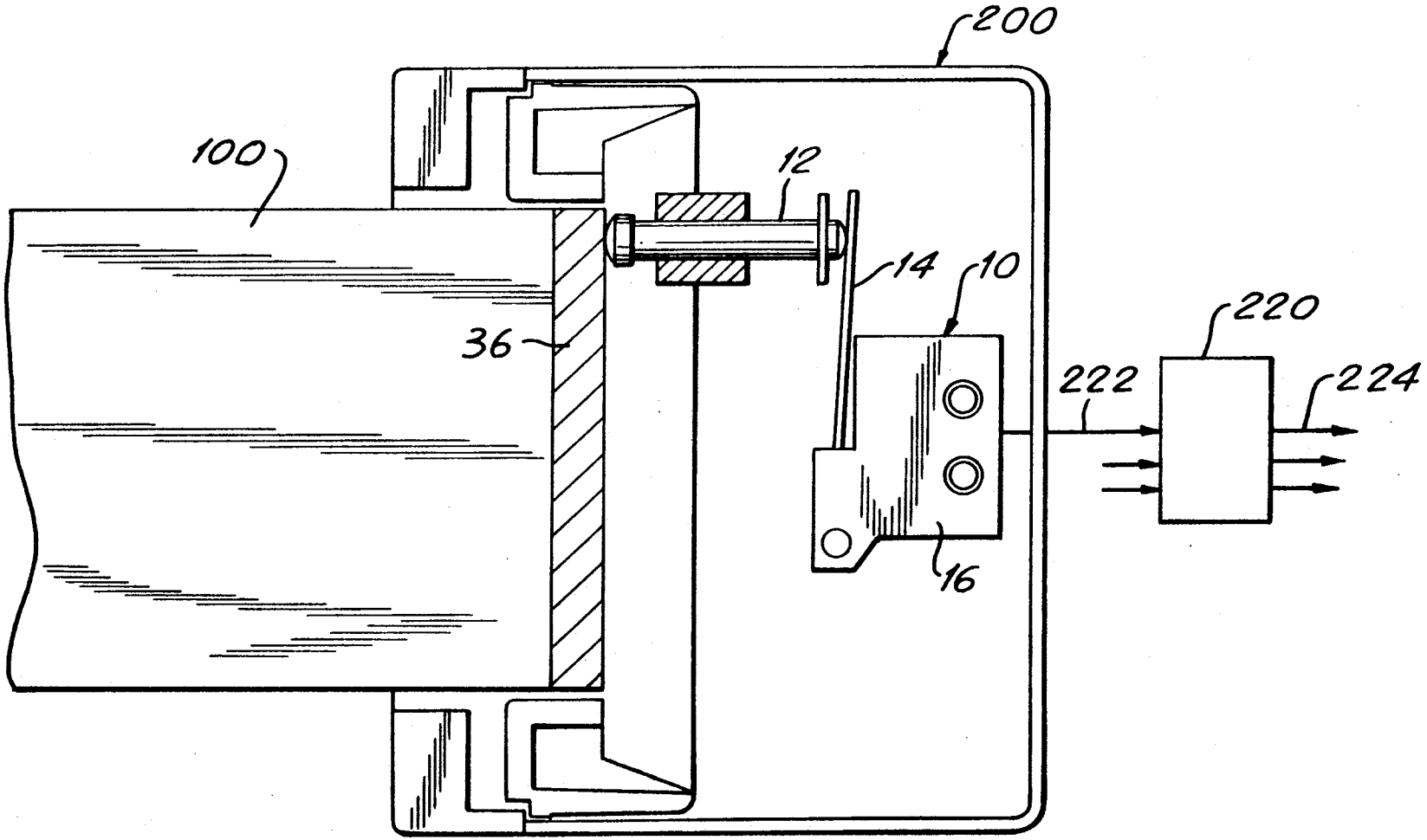
FIG. 3 is an end view taken along line x—x of FIG. 2.

When the cassette 100 is attached to the bill pusher and is ready to receive bills, the pusher plate 36 is in an open position and the switch pin 12 is contacting the pusher plate 36, as shown in FIGS. 1 and 2. The switch pin 12 causes the actuator element 14 to close the microswitch 16 to send a signal to the microprocessor 220. FIG. 3 is an end view taken along line x—x of FIG. 2, depicting the pusher plate 36 deflecting the switch pin 12 into the actuator element 14 to close the microswitch 16.

FIG. 4 is another cutaway side view of the cassette 100 and bill pusher 200 of FIG. 1, illustrating the bill storage compartment 30 filled with bills 60. The scissors mechanism 214 of the bill pusher 200 is shown fully extended, having pushed the actuator plate 212 and the pusher plate 36 past the rear wall 9 of the cassette. FIG. 4 thus depicts the middle of a bill pusher cycle.

Figure 5:
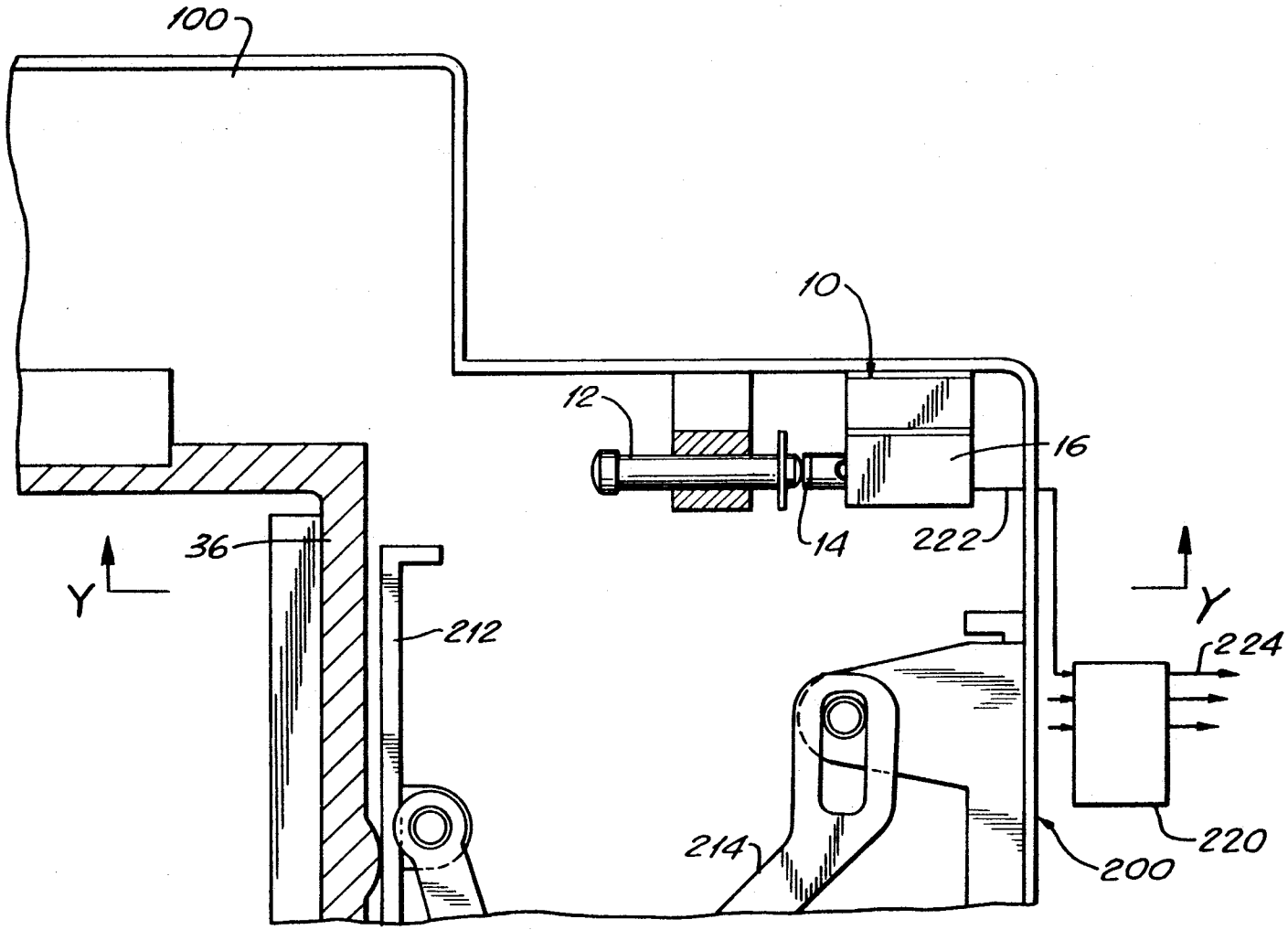
FIG. 5 is an enlarged, simplified illustration of block "B" of FIG. 4 depicting the security sensor in the unactuated position.

FIG. 5 is an enlarged, simplified illustration of block "B" of FIG. 4 depicting the security sensor 10 when the scissors mechanism 214 is fully extended. As shown, switch pin 12 is not contacting the pusher plate 36, and has been displaced in the direction of the pusher plate 36 by the actuating element 14. The actuating element 14 is spring biased by a spring (not shown) contained in the microswitch housing to extend and thus to open the contacts of the microswitch 16.

Figure 6:
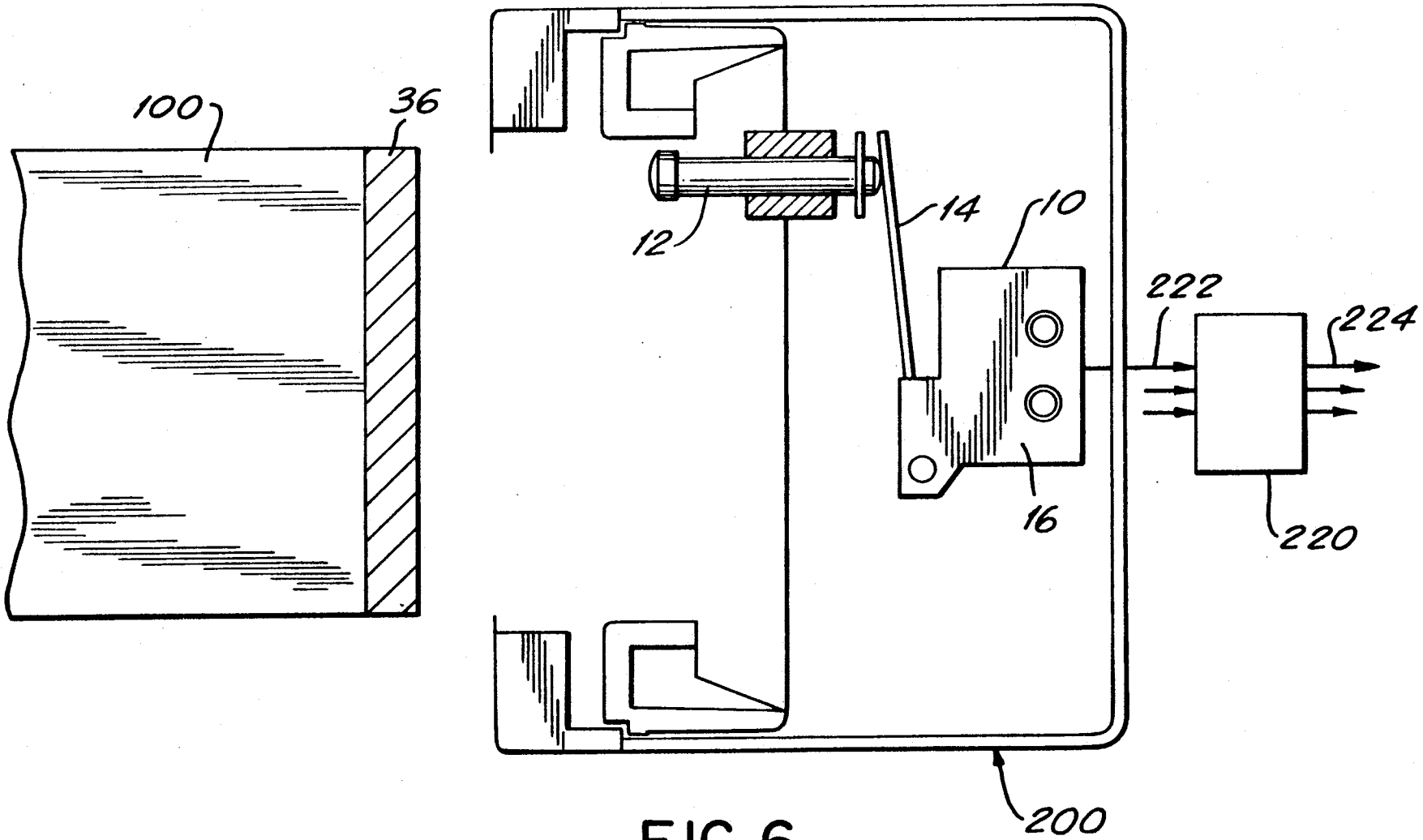
FIG. 6 is an end view taken along line y—y of FIG. 5.

FIG. 6 is an end view taken along line y—y of FIG. 5 of the security sensor 10 depicting the switch pin 12, the actuating element 14, and the microswitch 16 in the open position.

In the embodiment described above, the cassette is attached and locked to a cassette by turning the lever 2 such that the pusher plate 36 assumes its open position. When the pusher plate is opened it contacts the switch pin 12 which moves the actuator element 14 to close the microswitch 16. When the microswitch 16 is closed a signal is sent to a processing and control circuit such as the microprocessor 220, which acknowledges that the cassette is installed and initiates a bill pusher cycle. The security sensor is monitored during the bill pusher cycle by microprocessor 220 to verify that the microswitch 16 first opens and then closes as the pusher plate 36 first moves to load a bill into the bill compartment 30 and then returns to its open position. Based upon this monitoring, a decision is made regarding bill acceptor operation, as described below with respect to FIG. 7. Thus, as explained further below, the security sensor of the present invention prevents an accepted bill from being stacked outside the bill compartment 30.

Figure 7:
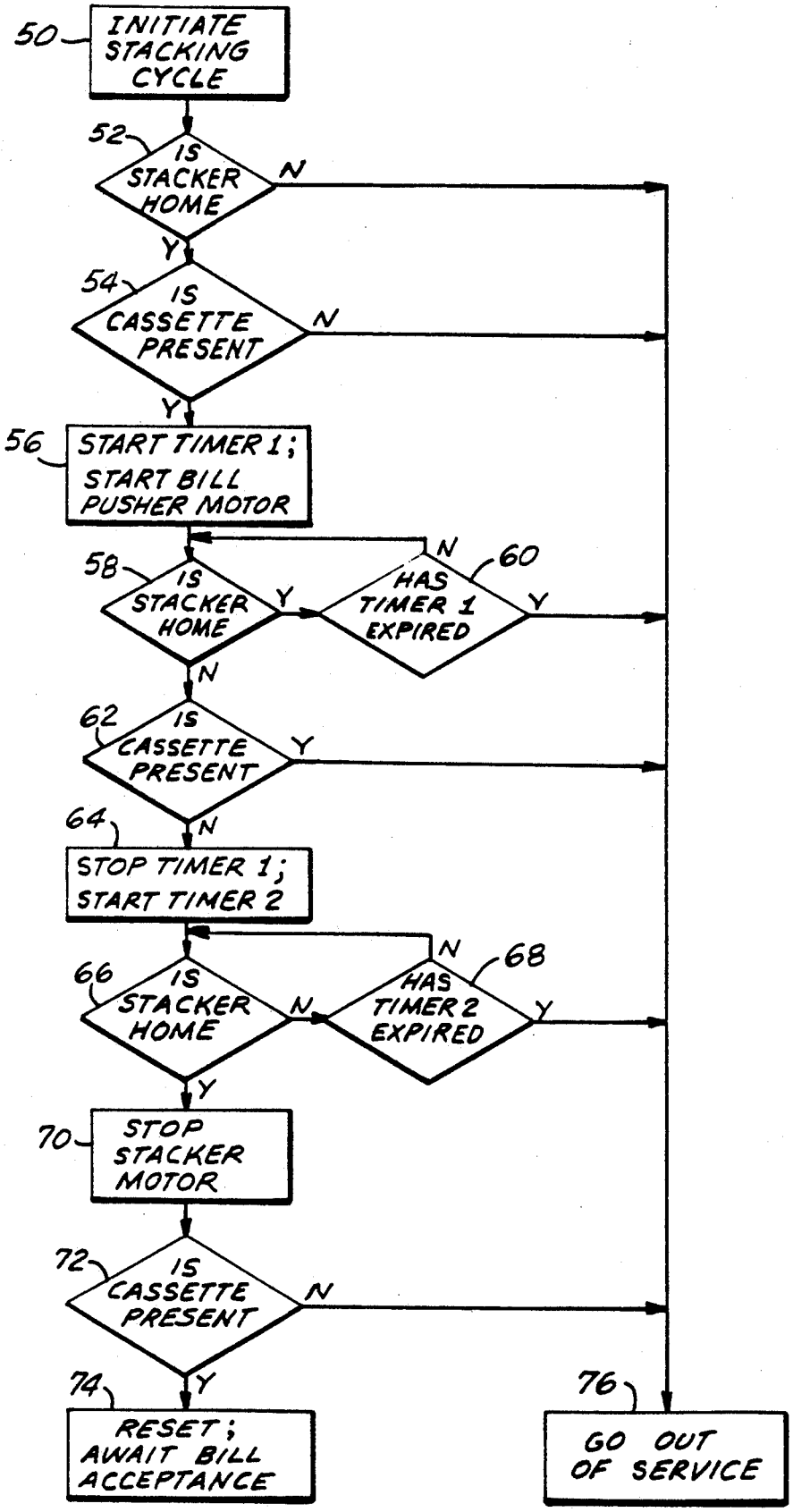
FIG. 7 is a flowchart illustrating a method of operation of the security sensor.

FIG. 7 is a flowchart depicting the operation of a bill acceptor system operating in accordance with the present invention. If the microswitch 16 of the security sensor 10 has been closed, a signal is sent to the microprocessor 220 indicating that a cassette has been attached, and a bill stacking or bill loading cycle is initiated (step 50). A bill stacking cycle consists of the bill pusher motor going from a home position to extension of the scissors mechanism 214, and back again to the home position. Thus, when a cassette is attached, the bill pusher will drive the pusher plate 36 into the bill storage compartment 30 and then retract, which opens and then closes the microswitch 16. The microswitch 16 thus sends signals to the microprocessor 220 which serve as a check for the proper installation of the cassette. The stacking cycle is also initiated if a bill has been accepted. A motor home sensor 211 (see FIG. 1) monitors the bill pusher so that the microprocessor 220 knows when the actuator plate 212 is in its home position. The home position for actuator plate 212 is shown in FIG. 1.

If the actuator plate 212 is not in the home position at the time the cassette is attached (step 52) then the bill validator will go out of service (step 76) because a jam condition is indicated. If the actuator plate 212 is home then the security sensor 10 is checked to see if the microswitch is closed (step 54) indicating the presence of the cassette. If the microswitch is opened then the bill acceptor will go out of service (step 76) because either no cassette is present, or the cassette is not properly attached. If the microswitch 16 is closed, a first timer is started and the bill pusher motor is energized (step 56). Next, the motor home sensor 211 is interrogated to see if the actuator plate 212 is still in the home position after the first timer has expired (steps 58 and 60). If the first timer expires without the actuator plate moving from the home position, then a jam condition is indicated and the bill validator goes out of service (step 76). If the actuator plate moves from home before the first timer expires, then the security sensor 10 is checked to see if the microswitch 16 opened (step 62). If the microswitch is still closed, then the bill validator goes out of service (step 76). This prevents manipulation of the switch pin 12 so that the microswitch 16 is always closed, in an attempt to have accepted bills stacked outside the cassette.

If the microswitch 16 opened after the actuator plate 212 moved from its home position then timer 1 is stopped and a second timer, timer 2, is started (step 64). Next, the motor home sensor 211 is monitored to see if the actuator plate returns to complete the bill pusher cycle (step 66). If timer 2 expires before the actuator plate 212 returns home (step 68), indicating a jam condition, then the bill validator goes out of service (step 76). If the actuator plate 212 returns home before timer 2 expires, then the stacker motor is stopped (step 70), and the security sensor 10 is interrogated to see if the microswitch 16 closed (step 72). If the microswitch remained open, indicating a possible jam condition, then the bill validator goes out of service (step 76). If the microswitch closed then the process successfully completed, and the microprocessor 220 resets and awaits the next bill loading cycle (step 74).

An alternate method for monitoring a bill pusher cycle involves using the microprocessor or other control circuitry to time how long it takes for the bill pusher cycle to complete according to both the motor home sensor 211 and the security sensor 10, and then to compare the difference of the two timed values to a predefined window of acceptable values. Thus, the microprocessor monitors the motor home sensor 211 during the bill pusher cycle and measures a first time value, and monitors the security sensor 10 during the same bill pusher cycle and measures a second time value. The second time value comprises the interval that starts when the microswitch opens as the pusher plate is pushed into the bill compartment and ends when the microswitch closes as the pusher plate returns to its open position. The difference between the first time value and the second time value is compared to a predefined window of acceptable values, and if the difference falls outside the window then the bill acceptor goes out of service.

Thus, when a cassette is attached to a bill pusher, the security sensor sends a signal indicating that the cassette has been attached, and the bill pusher is cycled and the security sensor monitored to check that the signals generated by the security sensor track the bill pusher cycle. In all cases the bill validator unit goes out of service if the bill pusher cycle fails to complete or if the security switch fails to track the bill pusher cycle.

Therefore, the microswitch cannot be manipulated to simulate cassette installation because then the proper bill pusher cycle will not be monitored, and thus the bill validator will go out of service. Likewise, a locked cassette or counterfeit cassette cannot be used to defraud the bill acceptor unit because the microswitch will not close when it is attached, and thus the bill validator will not go into service. Furthermore, the present invention makes manipulation of the microswitch to simulate a bill pusher cycle very difficult because if the microswitch is actuated in an asynchronous manner in an attempt to trick the bill validation system into accepting bills, the bill validator will go out of service. Further, the security sensor is monitored during normal operation and the bill acceptor is disabled if a jam condition arises. Thus, the present invention provides improved security for owners of bill validation systems.

Although an embodiment of the invention has been described above, it should be understood that one skilled in the art could make modifications and use other types of sensors, such as magnetic and optical sensors, without departing from the scope of the invention.

We claim:

1. A security arrangement for use with a bill acceptor and a removable cashbox, comprising:

a security sensor means which generates signals when a cashbox is attached and when a bill loading cycle takes place; and a processing and control element which monitors the security sensor means and disables the bill acceptor if the cashbox is not properly attached.

2. The apparatus of claim 1, further comprising:
a motor home sensor means associated with a bill pusher which monitors the bill loading cycle and generates signals, wherein the processing and control circuit disables the bill acceptor if the signals generated by the security sensor means are not in the proper sequence when compared to the signals generated by the motor home sensor means.

3. The apparatus of claim 1, wherein the security sensor means comprises:
a switch pin which comes into contact with a pusher plate of the cashbox;
an actuator element connected to the switch pin which is biased to deflect the switch pin in the direction of a pusher plate; and
a microswitch connected to the actuator element which closes when the pusher plate displaces the switch pin, and opens when the pusher plate moves away from the switch pin during the bill loading cycle.

4. The apparatus of claim 1, wherein the security sensor comprises an optical sensor.

5. The apparatus of claim 1, wherein the security sensor comprises a magnetic sensor.

6. The apparatus of claim 1, wherein the processing and control circuit is a microprocessor.

7. The apparatus of claim 1, wherein the security sensor means comprises:
a switch pin;
an actuator element connected to the switch pin; and
a microswitch connected to the actuator element for generating signals when the switch pin contacts the cashbox.

8. The apparatus of claim 1, further comprising:
a motor home sensor means for monitoring the bill loading cycle and for generating signals for comparison to the signals generated by the security sensor means.

9. A security arrangement for use in a bill acceptor system which comprises a bill validator, a bill pusher and a lockable, removable cassette, comprising:
a switch pin which is displaced by a pusher plate of the lockable, removable cassette when the pusher plate is in the open position;
a microswitch which closes when the switch pin is displaced by the pusher plate, and opens when the pusher plate moves to load a bill into the cassette; and
a processing and control circuit which monitors the microswitch and disables the bill validator if the lockable, removable cassette is not properly installed or if non-sequential operation of the bill pusher and the microswitch is detected.

10. A method of utilizing a security arrangement with a removable cashbox a bill acceptor system to prevent fraud, comprising:
actuating a security sensor to generate a signal when a cashbox is attached to a bill acceptor;
initiating a bill loading cycle;
monitoring the security sensor during the bill loading cycle for a particular sequence of signals indicating proper installation; and
disabling the bill acceptor if the cashbox was improperly installed.

11. The method of claim 10, further comprising:
monitoring the security sensor after proper installation of the cashbox; and
disabling the bill acceptor if the security sensor generates signals that are not sequential with respect to a bill loading cycle.

12. The method of claim 10, further comprising:
monitoring a motor home sensor associated with a bill pusher during the bill loading cycle for a particular sequence of signals;
comparing the signals generated by the motor home sensor and the security sensor; and
disabling the bill acceptor if the compared signals occurred in an improper sequence.

13. The method of claim 12, further comprising:
defining an acceptance window of time values;
generating a first time value based on the signals generated by the motor home sensor during a bill loading cycle;
generating a second time value based on the signals generated by the security sensor during a bill loading cycle;
subtracting the second time value from the first time value to generate a difference value;
comparing the difference value to the acceptance window; and
disabling the bill acceptor if the difference value is outside the acceptance window.

14. A method of utilizing a security sensor with a bill acceptor system comprising a lockable, removable cassette, a bill pusher and a bill validator, to prevent fraud, comprising:
actuating the security sensor and generating a signal when a pusher plate of the lockable, removable cassette is extended to its open position upon installation;
initiating a bill loading cycle wherein the bill pusher moves the pusher plate into a bill compartment of the cassette and then retracts such that the pusher plate returns to its open position;
monitoring the security sensor during the loading cycle; and
enabling the bill validator to accept bills if the security sensor generated signals in the proper sequence as the pusher plate moved during the bill loading cycle.

15. The method of claim 14, further comprising:
monitoring the signals generated by a motor home sensor associated with the bill pusher during the loading of a bill into the lockable, removable cassette;
comparing the signals generated by the motor home sensor to the signals generated by the security sensor; and
disabling the bill validator if the signals occurred in an improper sequence.

16. The method of claim 14, further comprising:
defining a window of acceptable time values;
generating a first time value based on the sequence of signals generated by a motor home sensor during a bill loading cycle;
generating a second time value based on the sequence of signals generated by the security sensor during the same bill loading cycle;
subtracting the second time value from the first time value to generate a difference value;
comparing the difference value to the acceptance window; and
disabling the bill acceptor if the difference value is not within the acceptance window.

17. The method of claim 16, wherein a microprocessor monitors the motor home sensor and the security sensor, generates the first and second time values, generates the difference value and compares it to the predefined window, and decides whether or not to disable the bill acceptor.

* * * * *

UNITED STATES PATENT AND TRADEMARK OFFICE

CERTIFICATE OF CORRECTION

PATENT NO. : 5,209,335

DATED : May 11, 1993

INVENTOR(S) : Shuren et al.

It is certified that error appears in the above-indentified patent and that said Letters Patent is hereby corrected as shown below:

Column 2, line 13, delete "th" and insert --the--.

Claim 10, column 7, line 53, insert --and-- following "cashbox".

Signed and Sealed this

Twenty-fifth Day of October, 1994

*Attest:*

*Attesting Officer*

Bruce Lehman

BRUCE LEHMAN

*Commissioner of Patents and Trademarks*